US010006682B2

(12) United States Patent
Murray et al.

(10) Patent No.: US 10,006,682 B2
(45) Date of Patent: Jun. 26, 2018

(54) SYSTEM AND METHOD FOR VENTING REFRIGERANT FROM AN AIR CONDITIONING SYSTEM

(71) Applicants: Bosch Automotive Service Solutions LLC, Warren, MI (US); Robert Bosch GmbH, Stuttgart (DE)

(72) Inventors: Gary P. Murray, Montpelier, OH (US); Mark W. McMasters, Owatonna, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 216 days.

(21) Appl. No.: 14/925,380

(22) Filed: Oct. 28, 2015

(65) Prior Publication Data

US 2016/0123642 A1 May 5, 2016

Related U.S. Application Data

(60) Provisional application No. 62/073,753, filed on Oct. 31, 2014.

(51) Int. Cl.
*F25B 45/00* (2006.01)

(52) U.S. Cl.
CPC ..... *F25B 45/00* (2013.01); *F25B 2345/002* (2013.01); *F25B 2345/003* (2013.01); *F25B 2345/006* (2013.01); *F25B 2345/007* (2013.01); *F25B 2345/0052* (2013.01)

(58) Field of Classification Search
CPC ..... F25B 45/00; F25B 45/0052; F25B 2345/002; F25B 2345/007; F25B 2345/003; F25B 2345/006
See application file for complete search history.

(56) References Cited

U.S. PATENT DOCUMENTS

2009/0188263 A1* 7/2009 Murray ..... B60H 1/00585 62/77

* cited by examiner

*Primary Examiner* — Len Tran
*Assistant Examiner* — Ana Vazquez
(74) *Attorney, Agent, or Firm* — Maginot Moore & Beck LLP

(57) ABSTRACT

An air conditioning service system includes a discharge unit including a discharge vessel, a vacuum pump fluidly connected to the discharge vessel, a scale configured to sense a weight of the discharge unit, a first valve arranged in an input line configured to fluidly connect the discharge vessel to an air conditioning system, and a vent valve arranged in a vent line and configured to fluidly connect the discharge vessel to the atmosphere. A controller operates the vacuum pump to evacuate the discharge vessel, obtains an evacuated weight of the discharge unit, operates the first valve to open to fill the discharge vessel with refrigerant, obtains a filled weight of the discharge unit, operates the vent valve to vent refrigerant from the discharge vessel, obtains a vented weight of the discharge unit, and determines a mass of refrigerant vented based upon the stored evacuated, filled, and vented weights.

6 Claims, 5 Drawing Sheets

SYSTEM AND METHOD FOR VENTING REFRIGERANT FROM AN AIR CONDITIONING SYSTEM

CLAIM OF PRIORITY

This application claims priority to U.S. Provisional Application Ser. No. 62/073,753 entitled "System and Method for Venting Refrigerant from an Air Conditioning System," filed Oct. 31, 2014, the disclosure of which is hereby incorporated herein by reference in its entirety.

TECHNICAL FIELD

This disclosure relates generally to refrigeration systems, and more particularly to refrigerant service systems for refrigeration systems.

BACKGROUND

Air conditioning systems are currently commonplace in homes, office buildings and a variety of vehicles including, for example, automobiles. Over time, the refrigerant included in these systems becomes depleted and/or contaminated. As such, in order to maintain the overall efficiency and efficacy of an air conditioning system, the refrigerant included therein is periodically replaced or recharged.

Portable carts, also known as recover, recycle, recharge ("RRR") refrigerant service carts, or air conditioning service ("ACS") units, are used in connection with servicing refrigeration circuits, such as the air conditioning unit of a vehicle. The portable machines include hoses coupled to the refrigeration circuit to be serviced. In some current refrigeration systems the refrigerant, for example R134a or R1234yf, used is expensive and can be hazardous if vented to the atmosphere. As such, a vacuum pump and compressor operate to recover refrigerant from the vehicle's air conditioning unit, flush the refrigerant, and subsequently store the recovered refrigerant in a refrigerant tank. The refrigerant can then be used in another refrigeration system. Recovering the refrigerant, however, requires the ACS unit to include filters, heat exchangers, a compressor, a storage tank, and a scale to weigh the storage tank.

Some newer air conditioning systems have begun using R744, or carbon dioxide, as an economical and eco-friendly refrigerant alternative. Removal of the R744 refrigerant from these air conditioning systems is done by venting the refrigerant to the atmosphere in a controlled manner. The R744, however, is at a very high static pressure in the air conditioning system at ambient conditions, such that the venting of the refrigerant must be controlled to prevent damage to components or elastomeric seals in the air conditioning system. What is needed, therefore, is an ACS unit that can accurately determine the flow rate of R744 refrigerant vented from an air conditioning system during a service operation.

Additionally, it is advantageous to measure the total mass discharged from the air conditioning system to aid in diagnostics of the air conditioning system, for example to determine if the system has a leak. Since the R744 refrigerant is vented to atmosphere, and not captured, it is difficult or impossible in conventional ACS units to accurately determine the quantity of refrigerant removed from the air conditioning system during the venting. What is needed, therefore, is an ACS unit that can accurately determine total mass of R744 refrigerant vented from an air conditioning system during a service operation.

SUMMARY

In one embodiment according to the disclosure, an air conditioning service system comprises a discharge unit including a discharge vessel, a vacuum pump fluidly connected to the discharge vessel, a scale configured to sense a weight of the discharge unit, a first valve arranged in an input line configured to fluidly connect the discharge vessel to an air conditioning system to receive refrigerant therefrom, and a vent valve arranged in a vent line and configured to fluidly connect the discharge vessel to the atmosphere. The air conditioning service system further includes a controller operably connected to the vacuum pump, the scale, the first valve, and the vent valve, the controller including a memory and a processor configured to execute commands stored in the memory to (i) operate the vacuum pump to evacuate the discharge vessel, (ii) obtain an evacuated weight of the discharge unit from the scale and store the evacuated weight in the memory, (iii) operate the first valve to open to fluidly connect the discharge vessel to the air conditioning system to receive refrigerant and to close to disconnect the discharge vessel from the air conditioning system when the discharge vessel is filled with refrigerant, (iv) obtain a filled weight of the discharge unit from the scale and store the filled weight in the memory, (v) operate the vent valve to vent refrigerant from the discharge vessel, (vi) obtain a vented weight of the discharge unit from the scale and store the vented weight in the memory, and (vii) determine a mass of refrigerant vented based upon the stored evacuated, filled, and vented weights.

In one embodiment of the air conditioning service system, the controller is further configured to monitor the weight of the discharge unit while the first valve is open and to operate the first valve to close when the weight of the discharge unit ceases to increase.

In another embodiment according to the disclosure, the air conditioning service system further comprises a pressure transducer configured to sense a pressure in the discharge vessel, and the controller is configured to monitor the pressure in the discharge vessel while the first valve is open and to operate the first valve to close when the pressure in the discharge vessel ceases to increase.

In a further embodiment, the air conditioning service system further comprises a pressure transducer configured to sense a pressure in the discharge vessel, and the controller is operably connected to the controller and is configured to operate the vent valve to vent refrigerant from the discharge vessel by operating the vent valve to open, monitoring the pressure in the discharge vessel while the vent valve is open, and operating the vent valve to close when the pressure in the discharge vessel drops below a first predetermined pressure threshold.

In some embodiments, the air conditioning system further comprises an oil drain receptacle and an oil drain valve configured to fluidly connect the discharge vessel to the oil drain receptacle. The controller is operably connected to the oil drain valve and is configured to operate the oil drain valve to open after operating the vent valve to close, monitor the pressure in the discharge vessel, and close the oil drain valve when the pressure in the discharge vessel drops below a second predetermined pressure threshold.

In one embodiment of the air conditioning service system, the controller is further configured to operate the vacuum pump to evacuate the discharge vessel after operating the oil drain valve to close and before obtaining the vented weight of the discharge unit.

In another embodiment according to the disclosure, a method of operating an air conditioning service system to vent an air conditioning system comprises evacuating a discharge vessel of a discharge unit to a vacuum pressure, obtaining an evacuated weight of the discharge unit using a scale and storing the evacuated weight in a memory, filling the discharge vessel with refrigerant from the air conditioning system, and obtaining a filled weight of the discharge unit using the scale and storing the filled weight in the memory. The method further includes venting the refrigerant from the filled discharge vessel, obtaining a vented weight of the discharge unit using the scale and storing the vented weight in the memory, and calculating, with a controller, a mass of refrigerant vented based on the evacuated, filled, and vented weights of the discharge unit.

In one embodiment of the method, the filling of the discharge vessel comprises fluidly connecting the discharge vessel to the air conditioning system, monitoring one of a first weight of the discharge unit and a pressure in the discharge vessel, and fluidly disconnecting the discharge vessel from the air conditioning system when the one of the first weight and the pressure ceases to increase.

In a further embodiment of the method, evacuating the discharge vessel comprises operating a vacuum pump to reduce a pressure in the discharge vessel until the pressure is equal to or less than the vacuum pressure.

In yet another embodiment of the method, venting the refrigerant comprises opening a vent valve to connect the discharge vessel to the atmosphere, and closing the vent valve when a pressure in the discharge vessel is equal to or less than a first predetermined pressure threshold.

In some embodiments of the method, venting the refrigerant further comprises opening an oil drain valve to connect the discharge vessel to an oil drain receptacle of the discharge unit after closing the vent valve and closing the oil drain valve when the pressure in the discharge vessel is equal to or less than a second predetermined pressure threshold.

In a further embodiment of the method, venting the refrigerant further comprises evacuating the discharge vessel to the vacuum pressure before obtaining the vented weight.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
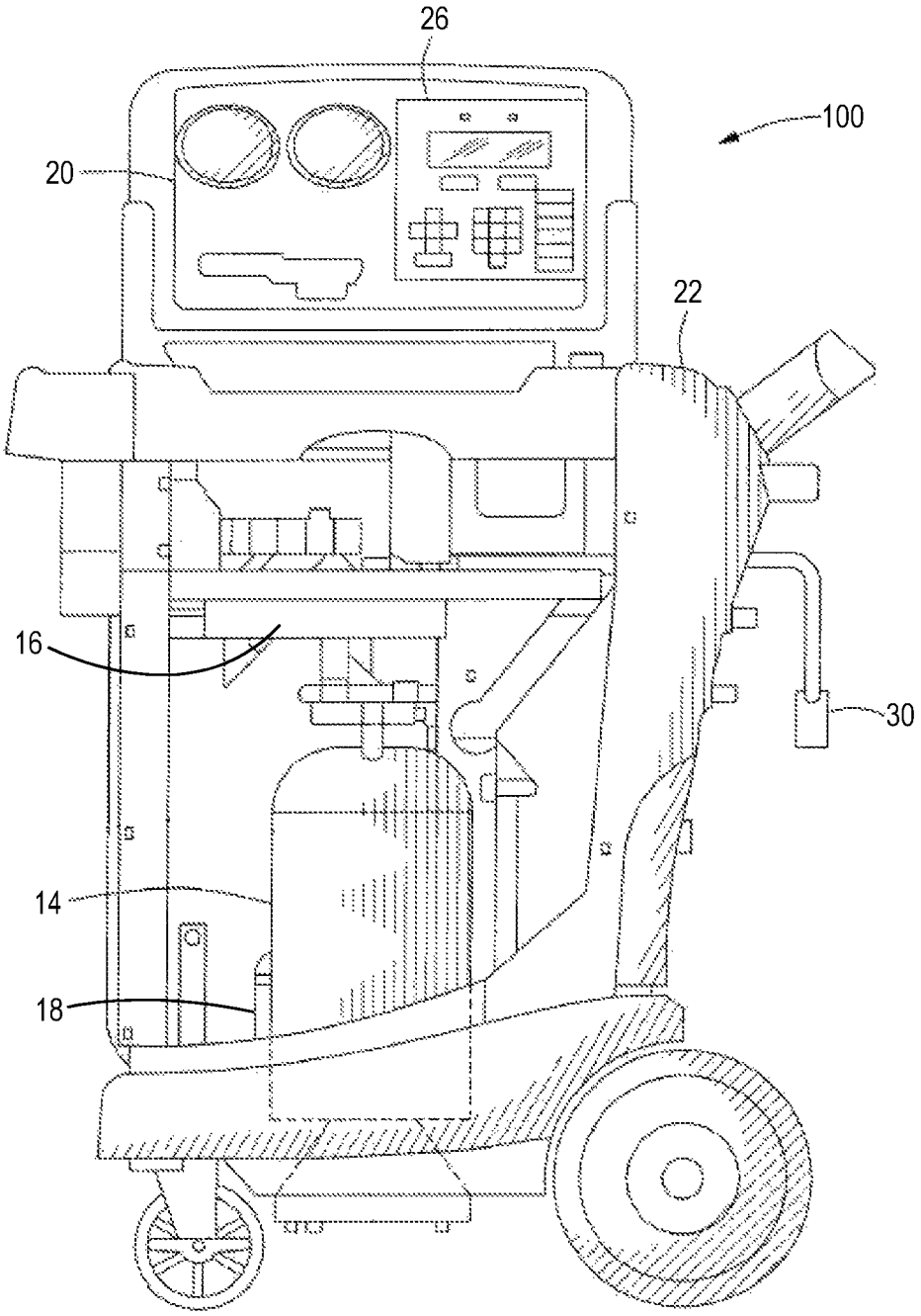
FIG. 1 is a partial cutaway front view of an ACS machine according to the disclosure.

FIG. 1 is an illustration of an air conditioning service ("ACS") system 100. The ACS unit 10 includes a refrigerant container or internal storage vessel ("ISV") 14, a manifold block 16, a compressor 18, a control module 20, and a housing 22. The exterior of the control module 20 includes an input/output unit 26 for input of control commands by a user and output of information to the user. Hose connections 30 (only one is shown in FIG. 1) protrude from the housing 22 to connect to service hoses that connect to an air conditioning ("A/C") system 40 (FIG. 2) and facilitate transfer of refrigerant between the ACS system 100 and the A/C system 40. The manifold block 16 is fluidly connected to the ISV 14, the compressor 18, and the hose connections 30 through a series of valves, hoses, and tubes, which are discussed in detail below with reference to FIG. 3.

The ISV 14 is configured to store refrigerant for the ACS system 100. No limitations are placed on the kind of refrigerant that may be used in the ACS system 100. As such, the ISV 14 is configured to accommodate any refrigerant that is desired to be charged to the A/C system. In some embodiments, the ISV 14 is particularly configured to accommodate one or more refrigerants that are commonly used in the A/C systems of vehicles (e.g., cars, trucks, boats, planes, etc.), for example R-134a, $CO_2$ (also known as R-744), or R-1234yf. In some embodiments, the ACS unit has multiple ISV tanks configured to store different refrigerants.

Figure 2:
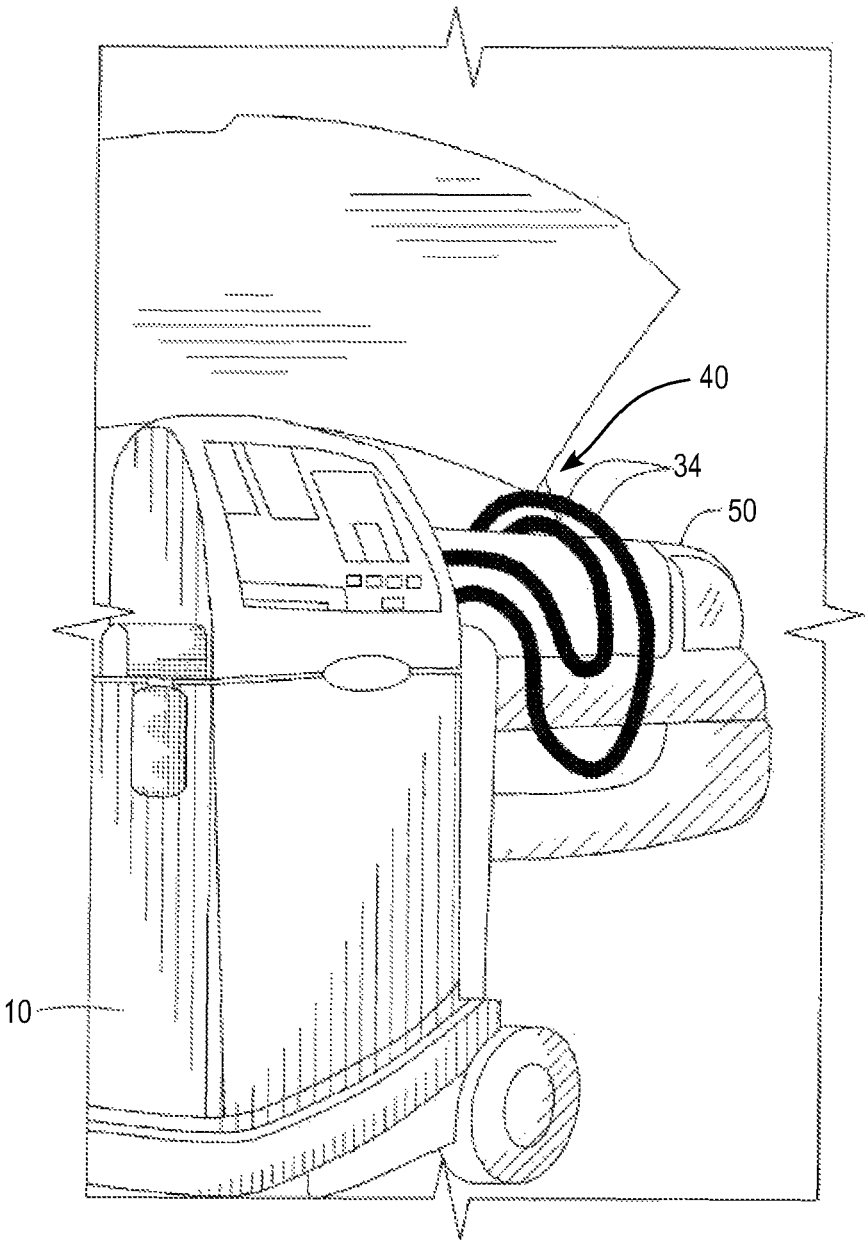
FIG. 2 is side perspective view of the ACS machine of FIG. 1 connected to a vehicle.

FIG. 2 is an illustration of a portion of the air conditioning recharging system 100 illustrated in FIG. 1 connected to the A/C system 40 of a vehicle 50. One or more service hoses 34 connect an inlet and/or outlet port of the A/C system 40 of the vehicle 50 to the hose connections 30 (shown in FIG. 1) of the ACS unit 10.

Figure 3:
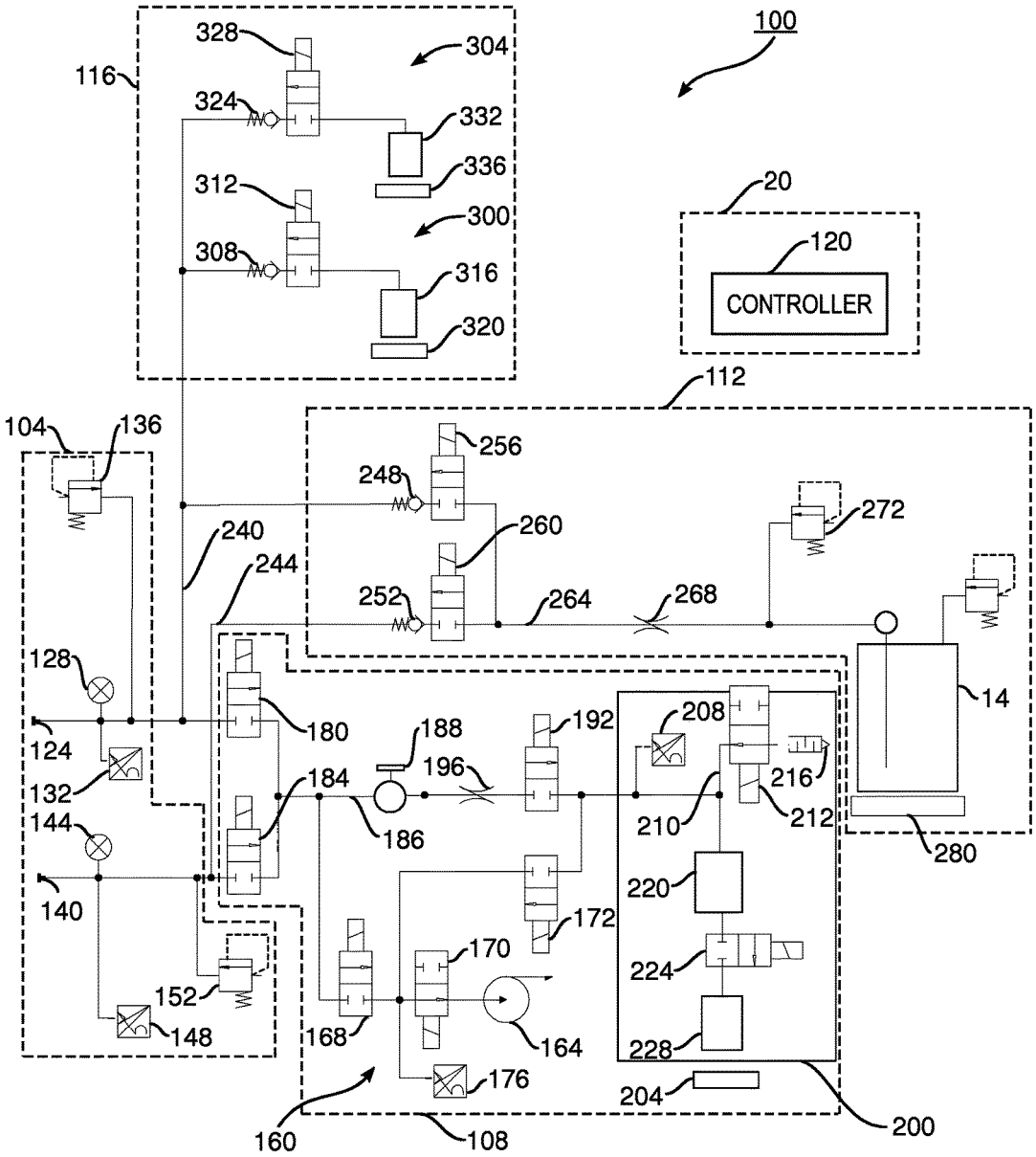
FIG. 3 is a schematic view of the ACS machine according to the disclosure configured to vent refrigerant to the atmosphere through control orifices.

FIG. 3 illustrates a schematic diagram of an ACS system 100 according to the disclosure. The ACS system 100 includes a coupling system 104, a discharge circuit 108, a charge circuit 112, an injection circuit 116, and a controller 120. The coupling system 104 includes a high-side coupler 124 connected to a high-side pressure gauge 128, a high-side pressure transducer 132, and a high-side pressure relief valve 136, and a low-side coupler 140 connected to a low-side pressure gauge 144, a low-side pressure transducer 148, and a low-side pressure relief valve 152. The low and high-side couplers 124, 140 include hose connections 30 (FIG. 2) configured to connect to service hoses 34 to connect the ACS system 100 to an air conditioning system, for example air conditioning system 40.

Referring back to FIG. 3, the discharge circuit 108 includes a vacuum pump subsystem 160 having a vacuum pump 164, three vacuum solenoid valves 168, 170, 172, and a vacuum transducer 176. The vacuum pump 164 is configured to produce a negative pressure in the discharge circuit 108.

The discharge circuit 108 further includes a high-side inlet solenoid valve 180 and a low-side inlet solenoid valve 184, which are connected to the high-side and low-side couplers 124, 140, respectively. The outlets of the inlet valves 180, 184 are both connected to a discharge line 186, which has a pressure regulator 188, a system discharge solenoid valve 192 and a control orifice 196. In some embodiments, the discharge line 186 may include multiple system discharge lines, each having a control orifice, and each of which may include a pressure regulator and/or a solenoid valve. As shown in FIG. 3, the discharge line 186 is further connected to a line of the vacuum subsystem both upstream and downstream of the pressure regulator 188, discharge valve 192, and control orifice 196.

The outlet of the system discharge solenoid valve leads to a system discharge unit 200, the entirety of which rests on a discharge scale 204, which measures the weight of the entire system discharge unit 200. In some embodiments, the discharge scale may be a conventional load cell. The system discharge unit 200 includes a pressure transducer 208, a vent passage 210 including a vent solenoid valve 212 and a diffuser 216, a system oil separator, or discharge vessel, 220, an oil drain solenoid valve 224, and an oil drain receptacle 228. The system oil separator 220 is configured to separate the refrigerant from oil entrained in the refrigerant during normal operation of the air conditioning system. The separated oil flows through the oil drain solenoid valve 224 into the oil drain receptacle 228, while the refrigerant is vented to the atmosphere through the vent passage 210 and diffuser 216 when the vent solenoid valve 212 is open.

The charge circuit 112 connects to the high-side coupler 124 via a high-side charge line 240 and to the low-side coupler 140 via a low-side charge line 244. In the charge circuit 112, the charge lines 240, 244, respectively, each include a check valve 248, 252 allowing flow only in the direction of the couplers 124, 140, and a charge solenoid valve 256, 260 to control flow during charging. The charge lines 240, 244 connect to a joint charge line 264, which includes an inflow orifice 268 to control the flow rate during charging and a pressure relief valve 272 to prevent excess pressure from building in the charge circuit 112. The joint charge line 264 connects to the ISV 14, which is positioned in the ACS system 100 on a refrigerant scale 280 configured to measure the weight of refrigerant in the ISV 14.

The injection circuit 116 is connected to the high-side charge line 240 and includes an oil injection subsystem 300 and a dye injection subsystem 304. The oil injection subsystem 300 includes a check valve 308 configured to enable flow only in the direction of the high-side coupler 124, an oil injection solenoid valve 312 configured to regulate flow of oil, an oil vessel 316, and an oil vessel scale 320 configured to measure the weight of the oil vessel 316. The oil injection subsystem 300 is configured to replenish oil that is entrained in the refrigerant removed from the air conditioning system to ensure proper operation of the air conditioning system.

The dye injection subsystem 304 includes a check valve 324 configured to enable flow only in the direction of the high-side coupler 124, a dye injection solenoid valve 328 configured to regulate flow of oil, a dye vessel 332, and a dye vessel scale 336 configured to measure the weight of the dye vessel 332. The dye injection subsystem is configured to inject dye into the air conditioning system to enable a technician to perform diagnostic operations, for example detecting leaks in the air conditioning system.

Figure 4:
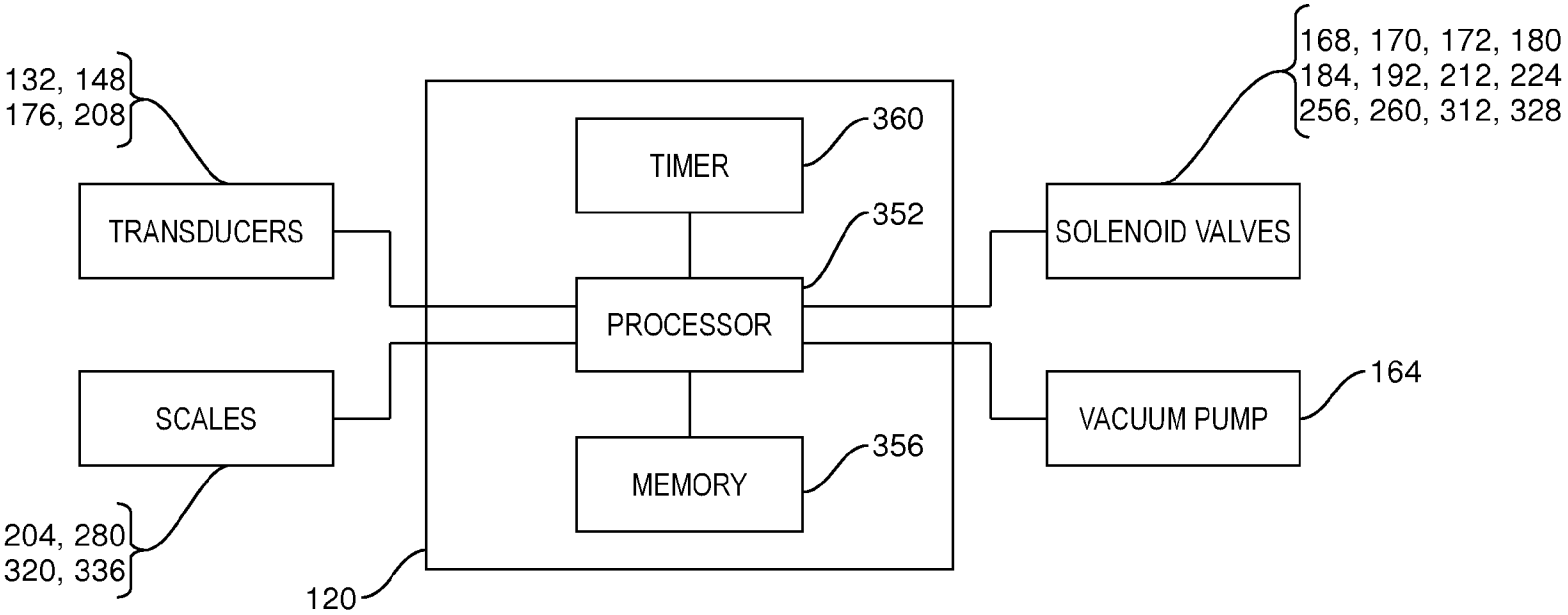
FIG. 4 is a schematic view of the control components of the ACS machine of FIG. 3.

FIG. 4 is a schematic diagram of the controller 120 and the components operably connected to the controller 120 in the ACS system 100. Operation and control of the various components and functions of the ACS system 100 are performed with the aid of the controller 120. The controller 120 is implemented with a general or specialized programmable processor 352 that executes programmed instructions. In some embodiments, the controller includes more than one general or specialized programmable processor. The instructions and data required to perform the programmed functions are stored in a memory unit 356 associated with the controller 120, which may be integral with the controller 120 (as shown in FIG. 4) or may be a separate unit. The processor 352, memory 356, and interface circuitry configure the controller 120 to perform the functions and processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The pressure transducers 132, 148, 176, 208 are configured to transmit electronic signals representing the sensed pressure at their respective locations to the processor 352, and the refrigerant scale 280, the injection scales 320, 336, and the discharge unit scale 204 transmit electronic signals representing the sensed weight in the ISV 14, the oil vessel 316, the dye vessel 332, and the discharge unit 200, respectively, to the processor 352. The processor 352 obtains the signals from the pressure transducers 132, 148, 176, 208, and the scales 204, 280, 320, 336 at predetermined time intervals or as necessary to perform computations, and stores relevant values from the transducers and scales in the memory 356.

The processor 352 is also electrically connected to the solenoid valves 168, 170, 172, 180, 184, 192, 212, 224, 256, 260, 312, 328, and is configured to transmit electronic signals that operate the valves to operate to open or close. The processor 352 is further connected to the vacuum pump 164 and is configured to transmit electronic signals to operate the vacuum pump 164 to activate and deactivate. The controller 120 also includes a timer 360, which may be integral with the controller 120, as illustrated in FIG. 4, or may be embodied as a separate timer circuit.

Figure 5:
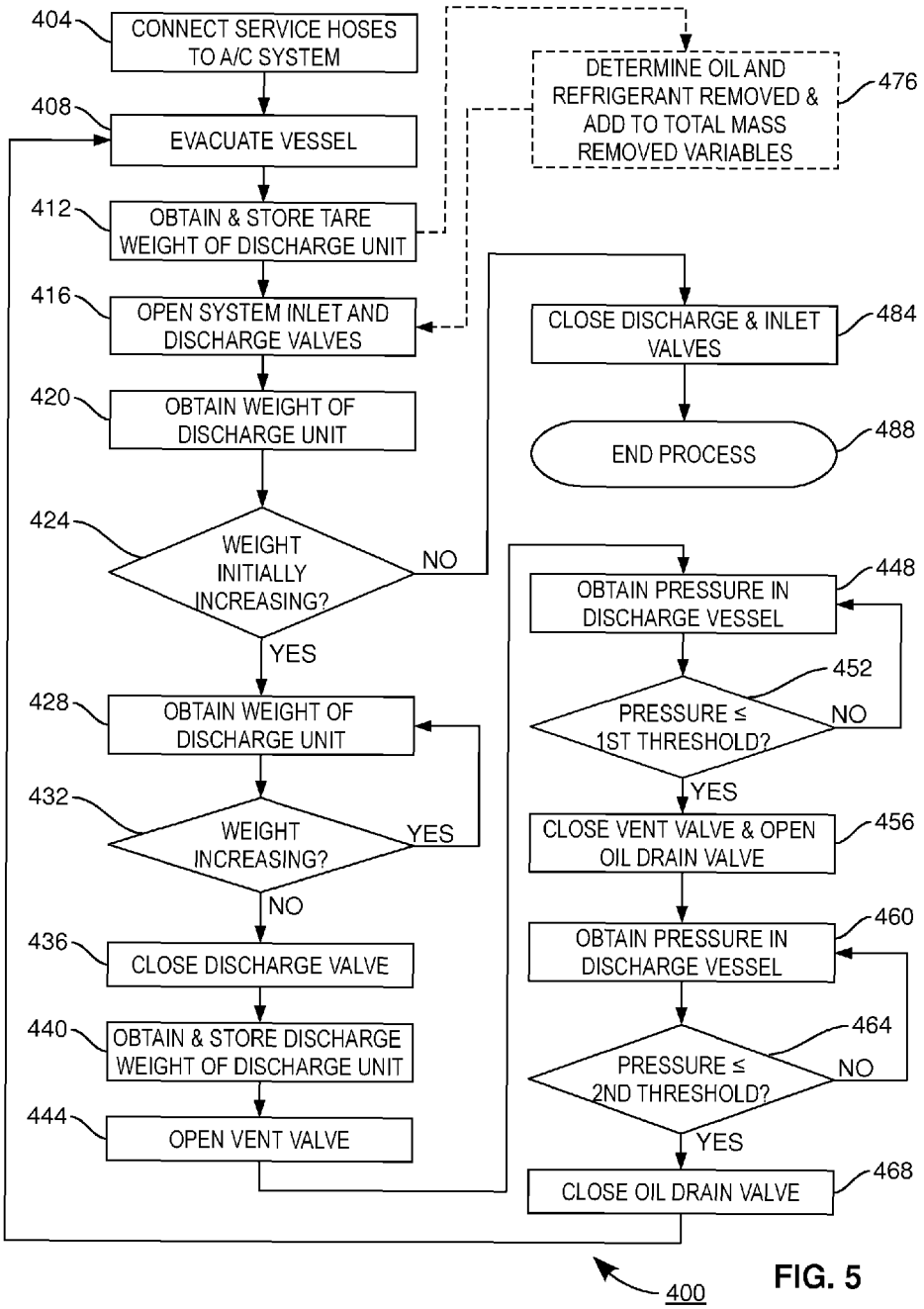
FIG. 5 is a process diagram of a method of operating an ACS machine during a venting operation.

FIG. 5 illustrates a method 400 of operating an embodiment of an ACS system, such as the ACS unit 100 described above with reference to FIGS. 3 and 4, for a venting operation, during which the refrigerant is vented to the atmosphere. The processor 352 in the controller 120 is configured to execute programmed instructions stored in the memory 356 to operate the components in the ACS unit 100 to implement the method 400. The process begins with the service hoses being connected to the air conditioning system and to the ports of the ACS system (block 404).

Once the hoses are connected, the controller operates to evacuate the system oil separator, or discharge vessel (block 408). The solenoid valves of the vacuum subsystem between the vacuum pump and the discharge vessel are opened, and the vacuum pump is activated. The vacuum pump removes residual refrigerant from the discharge vessel, leaving the discharge vessel at near zero absolute pressure.

The controller then obtains the tare weight of the discharge unit, for example discharge unit 200 of the ACS system 100 discussed above, from the scale 204 attached to the discharge unit and stores the tare weight in the memory (block 412). The tare weight represents the weight of the discharge unit when the discharge vessel is at a vacuum. The controller then operates the inlet and discharge valves to open (block 416), enabling refrigerant, with oil entrained therein, to flow from the air conditioning system into the discharge vessel. The controller obtains the weight of the discharge unit (block 420) and monitors whether the weight is increasing initially (block 424), indicating that refrigerant is flowing from the air conditioning system into the discharge unit.

If the weight is increasing initially, the controller obtains the weight of the discharge unit again (block 428) and determines whether the weight is continuing to increase (block 432). If the weight is continuing to increase, then the process repeats obtaining the weight of the discharge unit and determining whether the weight is increasing at predetermined sampling intervals. During this repetition of blocks 428 and 432, the controller also monitors the flow rate of the refrigerant into the discharge vessel. If the flow rate exceeds a predetermined upper threshold, which, in one embodiment is approximately 100-140 grams per second, and in another specific embodiment is approximately 120 grams per second, the controller is configured to close the discharge valve and delay for a predetermined time interval before reopening the discharge valve. The flow rate is therefore prevented from exceeding the upper threshold, at which damage may result to the components and elastomer seals in the air conditioning system to which the ACS system is attached.

In some embodiments, the monitoring of the weight of the discharge unit in blocks 420, 424, 428, and 432 is replaced with monitoring of the pressure in the discharge vessel. The controller obtains a signal representing the pressure in the discharge vessel from the discharge transducer in place of obtaining the weight of the discharge unit, and determines whether the pressure is increasing in place of determining whether the weight is increasing. The flow rate into the discharge vessel is monitored based on converting the change in pressure to a change in mass to ensure that the flow rate does not exceed the predetermined upper threshold.

Once the weight of the discharge unit ceases to increase (block 432), the pressure has equalized between the air conditioning system and the discharge vessel. The controller proceeds to close the discharge valve (block 436), and then obtains the weight of the discharge unit (block 440). The discharge weight represents the weight of oil and refrigerant transferred from the air conditioning system into the discharge vessel while the discharge valve was open, and is calculated by subtracting the tare weight determined at block 412 from the weight of the discharge vessel obtained after the discharge valve is closed. The determined discharge weight is then stored in the memory.

The controller opens the vent valve (block 444), allowing the refrigerant contained under pressure in the discharge vessel to escape into the atmosphere. As the refrigerant is being vented, the controller obtains the signal from the discharge pressure transducer indicating the pressure in the discharge vessel (block 448) and determines whether the pressure is equal to or less than a first predetermined threshold (block 452). In one embodiment, the first predetermined threshold is approximately one bar gage pressure. If the pressure remains above the first pressure threshold, the process continues at block 448.

Once the pressure in the discharge vessel is less than or equal to the first threshold, the controller operates to close the vent valve (e.g. valve 212 in the embodiment of FIG. 3) and open the oil drain valve (e.g. valve 224 of the embodiment of FIG. 3) (block 456). Oil in the discharge vessel, which has been separated from the refrigerant in the discharge vessel, is urged through the oil drain valve and into the oil drain receptacle by the increased pressure in the discharge vessel. The controller continues to obtain the pressure in the oil separator (block 460) and determines whether the pressure has decreased below a second pressure threshold, which is less than the first pressure threshold (block 464). In one embodiment, the second pressure threshold is near zero gage pressure. Once the pressure is equal to or less than the second pressure threshold, the refrigerant in the discharge vessel has been vented and the controller operates to close the oil drain valve (block 468). The process then continues at block 408.

After the first cycle through blocks 408-468, the controller is configured to perform a determination of the refrigerant mass and oil mass removed. Upon obtaining the tare weight (block 412), the controller is configured to determine the oil and refrigerant removed from the air conditioning system in the previous cycle. During the prior cycle, a quantity of oil and refrigerant was added to the oil drain receptacle, increasing the weight of the receptacle. The refrigerant has been completely removed from the discharge vessel during the venting and evacuation of the discharge vessel. The newly obtained tare weight is therefore equal to the previous tare weight plus the weight of oil added to the oil drain receptacle. In order to determine the amount of oil removed from the air conditioning system during the previous cycle, therefore, the controller subtracts the previous tare weight from the newly obtained tare weight. The quantity of oil added to the receptacle is then added to a total oil removed variable stored in the memory of the controller. Once the venting operation is complete, the total oil removed is known, and the quantity of oil removed can be injected into the system by the oil injection system to ensure proper operation of the air conditioning system.

The combined weight of refrigerant and oil removed from the air conditioning system in the previous cycle was determined in block 440 above as the discharge weight. Since the weight of oil removed is now known, the weight of refrigerant vented from the system can be calculated as the discharge weight (oil+refrigerant weight) minus the weight of the oil removed. The controller computes the weight of refrigerant vented, and adds the vented weight to the total refrigerant vented variable. After the venting operation is complete, the total refrigerant vented variable can be used to determine the quantity of refrigerant to charge back into the air conditioning system. Additionally, if the total refrigerant vented variable is less than a certain value, the controller may be configured to activate a diagnostic message indicating that the air conditioning system vented may have a refrigerant leak.

Once the air conditioning system is emptied, or essentially emptied, of refrigerant, there will no longer be transfer of refrigerant from the air conditioning system to the discharge vessel when the inlet and discharge valves are opened (block 416). Therefore, when the weight of the discharge unit is obtained at block 420, the controller will determine at block 424 that the weight is not initially increasing. Likewise, in systems configured to monitor the pressure for increases instead of the weight, the pressure in the discharge vessel will not increase when the air conditioning system is essentially emptied of refrigerant. The controller will then close the discharge and inlet valves (block 484), and the venting operation is complete (block 488).

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

The invention claimed is:

1. An air conditioning service system comprising:

a discharge unit including a discharge vessel;

a vacuum pump fluidly connected to the discharge vessel;

a scale configured to sense a weight of the discharge unit;

a first valve arranged in an input line configured to fluidly connect the discharge vessel to an air conditioning system to receive refrigerant therefrom;

a vent valve arranged in a vent line and configured to fluidly connect the discharge vessel to the atmosphere; and a controller operably connected to the vacuum pump, the scale, the first valve, and the vent valve, the controller including a memory and a processor configured to execute commands stored in the memory to (i) operate the vacuum pump to evacuate the discharge vessel, (ii) obtain an evacuated weight of the discharge unit from the scale and store the evacuated weight in the memory, (iii) operate the first valve to open to fluidly connect the discharge vessel to the air conditioning system to receive refrigerant and to close to disconnect the discharge vessel from the air conditioning system when the discharge vessel is filled with refrigerant, (iv) obtain a filled weight of the discharge unit from the scale and store the filled weight in the memory, (v) operate the vent valve to vent refrigerant from the discharge vessel, (vi) obtain a vented weight of the discharge unit from the scale and store the vented weight in the memory, and (vii) determine a mass of refrigerant vented based upon the stored evacuated, filled, and vented weights.

2. The air conditioning service system of claim 1, wherein the controller is further configured to monitor the weight of the discharge unit while the first valve is open and to operate the first valve to close when the weight of the discharge unit ceases to increase.

3. The air conditioning service system of claim 1, further comprising:

a pressure transducer configured to sense a pressure in the discharge vessel, wherein the controller is configured to monitor the pressure in the discharge vessel while the first valve is open and to operate the first valve to close when the pressure in the discharge vessel ceases to increase.

4. The air conditioning service system of claim 1, further comprising a pressure transducer configured to sense a pressure in the discharge vessel, wherein the controller is operably connected to the controller and is configured to operate the vent valve to vent refrigerant from the discharge vessel by operating the vent valve to open, monitoring the pressure in the discharge vessel while the vent valve is open, and operating the vent valve to close when the pressure in the discharge vessel drops below a first predetermined pressure threshold.

5. The air conditioning system of claim 4, further comprising:

an oil drain receptacle; and an oil drain valve configured to fluidly connect the discharge vessel to the oil drain receptacle, wherein the controller is operably connected to the oil drain valve and is configured to operate the oil drain valve to open after operating the vent valve to close, monitor the pressure in the discharge vessel, and close the oil drain valve when the pressure in the discharge vessel drops below a second predetermined pressure threshold.

6. The air conditioning system of claim 5, wherein the controller is further configured to operate the vacuum pump to evacuate the discharge vessel after operating the oil drain valve to close and before obtaining the vented weight of the discharge unit.

* * * * *